US010352669B2

(12) United States Patent
Fournier et al.

(10) Patent No.: US 10,352,669 B2
(45) Date of Patent: Jul. 16, 2019

(54) ADVANCED AERODYNAMIC PROJECTILE AND METHOD OF MAKING SAME

(71) Applicant: Badlands Precision LLC, Yankton, SD (US)

(72) Inventors: George Richard Fournier, Yankton, SD (US); Jason M. Sejnoha, Yankton, SD (US)

(73) Assignee: Badlands Precision LLC, Yankton, SD (US)

( * ) Notice: Subject to any disclaimer, the term of this patent is extended or adjusted under 35 U.S.C. 154(b) by 0 days.

(21) Appl. No.: 15/282,160

(22) Filed: Sep. 30, 2016

(65) Prior Publication Data

US 2018/0094911 A1 Apr. 5, 2018

(51) Int. Cl.

| | |
|---|---|
| ***F42B 12/34*** | (2006.01) |
| ***F42B 14/02*** | (2006.01) |
| ***F42B 10/42*** | (2006.01) |
| ***F42B 12/74*** | (2006.01) |
| ***F42B 30/02*** | (2006.01) |
| ***F42B 33/00*** | (2006.01) |

(52) U.S. Cl.

CPC ..... *F42B 12/34* (2013.01); *F42B 10/42* (2013.01); *F42B 12/74* (2013.01); *F42B 14/02* (2013.01); *F42B 30/02* (2013.01); *F42B 33/00* (2013.01)

(58) Field of Classification Search

CPC ..... F42B 12/34; F42B 12/00; F42B 14/02; F42B 14/00; F42B 12/74; F42B 33/00; F42B 30/02; F42B 10/42

USPC ..... 102/506–510

See application file for complete search history.

(56) References Cited

U.S. PATENT DOCUMENTS

| | | | | |
|---|---|---|---|---|
| 1,944,885 | A * | 1/1934 | Gerlich | F41A 21/16 102/514 |
| 2,045,964 | A | 6/1936 | Rinkel | |
| 3,069,748 | A | 12/1962 | Nosler | |
| 3,142,256 | A * | 7/1964 | Mack | F42B 12/78 102/508 |
| 3,157,137 | A | 11/1964 | Burns, Jr. | |
| 4,044,685 | A * | 8/1977 | Avcin | F42B 12/34 102/508 |
| 4,655,140 | A | 4/1987 | Schirneker | |
| 4,813,635 | A * | 3/1989 | Paterson | B62D 35/001 244/130 |
| 4,878,434 | A * | 11/1989 | Sommet | F42B 12/78 102/514 |
| 5,131,123 | A | 7/1992 | Brooks | |
| 5,208,424 | A | 5/1993 | Schluckebier et al. | |
| 5,259,320 | A | 11/1993 | Brooks | |
| 5,339,743 | A | 8/1994 | Scarlata | |
| 5,357,866 | A | 10/1994 | Schluckebier et al. | |
| 5,385,101 | A | 1/1995 | Corzine et al. | |
| 5,515,787 | A | 5/1996 | Middleton | |

(Continued)

FOREIGN PATENT DOCUMENTS

| | | | | |
|---|---|---|---|---|
| WO | WO-2013086544 A2 * | 6/2013 | | F42B 12/34 |

*Primary Examiner* — Jonathan C Weber

(74) *Attorney, Agent, or Firm* — Whitaker Chalk Swindle & Schwartz PLLC; Decker Cammack

(57) ABSTRACT

A projectile is improved aerodynamically by cutting grooves having parabolic transitions between the depth of the groove and the bearing surface. An ejectable tip is attached to the leading edge of the projectile to facilitate greater ballistic coefficient during flight and improved expansion upon impact at a soft target.

16 Claims, 5 Drawing Sheets

(56) References Cited

U.S. PATENT DOCUMENTS 6,257,149 B1 7/2001 Cesaroni
6,305,292 B1 10/2001 Burczynski et al.
6,776,101 B1 * 8/2004 Pickard ..... F42B 12/34 102/507
6,805,057 B2 10/2004 Carr et al.
6,845,717 B1 * 1/2005 Sauvestre ..... F42B 12/34 102/510
6,935,243 B2 8/2005 Dippold
6,971,315 B2 * 12/2005 Knappworst ..... F42B 12/34 102/508
7,201,104 B2 * 4/2007 McMurray ..... F42B 7/08 102/520
7,299,750 B2 * 11/2007 Schikora ..... F42B 12/34 102/506
7,360,491 B2 4/2008 Sanborn
7,380,502 B2 * 6/2008 Emary ..... F42B 12/34 102/506
8,161,885 B1 * 4/2012 Emary ..... F42B 12/34 102/506
8,186,277 B1 * 5/2012 King ..... F42B 12/74 102/507
8,393,273 B2 3/2013 Weeks et al.
8,511,233 B2 * 8/2013 Nilsson ..... F42B 12/34 102/509
D733,252 S * 6/2015 Burczynski ..... B62D 35/001 D22/115
9,188,414 B2 * 11/2015 Burczynski ..... F42B 12/34
9,316,468 B2 * 4/2016 Rall ..... F42B 12/34
9,383,178 B2 7/2016 Powers, Jr.
D774,159 S * 12/2016 Holtmeyer ..... D22/116
2004/0079256 A1 * 4/2004 McMurray ..... F42B 7/08 102/520
2005/0241523 A1 * 11/2005 Schikora ..... F42B 12/34 102/510
2006/0278117 A1 * 12/2006 Emary ..... F42B 12/34 102/519
2009/0096687 A1 * 4/2009 Gentilman ..... B28B 1/00 343/705
2011/0214582 A1 * 9/2011 Glasser ..... F42B 12/44 102/439
2012/0111220 A1 * 5/2012 King ..... F42B 12/34 102/509
2014/0318406 A1 * 10/2014 Rall ..... F42B 33/001 102/510
2015/0226531 A1 * 8/2015 Silvers ..... F42B 5/28 102/439
2015/0354930 A1 * 12/2015 Fricke ..... F42B 12/34 102/439
2016/0153757 A1 * 6/2016 Mahnke ..... F42B 10/22 102/501
2016/0252334 A1 * 9/2016 Cary ..... F42B 10/46 244/130
2016/0327380 A1 * 11/2016 Kunz ..... F42B 14/02

* cited by examiner

ADVANCED AERODYNAMIC PROJECTILE AND METHOD OF MAKING SAME

BACKGROUND OF THE INVENTION

1. Field of the Invention

This invention is directed to projectiles designed and manufactured for use in metallic cartridges for use in a firearm. The design of modern rifle cartridges has remained largely unchanged for over a century. A metallic casing designed to fit in a specified chamber of a firearm has a base with a primer pocket, a cavity, a mouth, and a projectile (bullet) seated in the mouth of the case. As will be shown below, the bullet may sometimes be "crimped" by the case mouth to ensure a tighter and more consistent fit of the bullet within the case mouth.

The primer pocket is sized to accept a metallic primer containing a primary explosive that ignites when struck by a firing pin of the firearm, causing sufficient heat and pressure to ignite incendiary powder disposed within the cavity of the metallic cartridge. The ignition of the powder creates pressure within the case that propels the bullet from the mouth of the case, through the barrel of the firearm, and out of the firearm's muzzle toward a target. The present invention is directed to the projectile of a modern rifled firearm.

2. Background of the Invention and Description of Related Art

Projectiles for use in rifled firearms have been in existence for over 150 years. The earliest projectiles were cast from molten lead into molds that were designed to be fired from a firearm of a specific caliber. Over time, bullet makers found that more uniform and reliable projectiles could be made from a process called swaging. Swaging is the process of applying high pressure to a malleable metal in a die press to force the metal to flow into the die form. The majority of bullets today are made through swaging lead into pre-swaged cups made of copper or another gilding metal alloy. These are known as jacketed bullets, due to the copper or gilding metal functioning as a "jacket" over the lead core, which in turn allows the bullets to be fired at higher velocities in rifled barrels, due to the fact that lead-only bullets under higher heat and pressure will deform, and in some cases, have cuts created along the lands of the barrel that causes a loss of pressure, and thus, lower velocity. These jacketed bullets are generally known as "cup and core" bullets.

Cup and core bullets offer the advantages described above, but also have some disadvantages. One disadvantage of cup and core bullets is that a swaged cup and core bullet has been shown to separate upon impact, causing the possibility of an inhumane kill or a wounded animal in a hunting scenario. Many bullet makers have tried to address this in different ways. For example, John Nosler obtained U.S. Pat. No. 3,003,420 for his "Partition®" bullet in 1961. The Nosler Partition® included a swaged jacketed lead base separated from a lead core nose by a copper jacket that had a copper wall, or "partition," that separated the two cores. This allowed the lead core base to stay intact as the bullet penetrates a game animal, retaining weight for momentum and penetration depth while allowing the nose of the bullet to expand to create a larger wound channel for a more humane game harvest. Other attempts to improve the swaged bullet include, e.g., U.S. Pat. No. 3,431,612 to Darigo, et al., and U.S. Pat. No. 4,387,492 to Inman which relate to electroplating a jacket onto a lead core. While these technologies represented improvements over traditional cast, swaged, and cup and core designs, the bullets were still lead-based, which is a toxic metal.

Due to the concern of lead poisoning by bullets fired in the outdoors, especially in areas where waterfowl congregate, many bullet makers have begun manufacturing solid-copper or solid lead-free bullets that are environmentally safer than lead. These solid copper, or gilding-metal, lead-free bullets have certain advantages and disadvantages. One advantage is that the harder alloys of the lead-free bullets resist deformation in the chamber of a rifle and in the rifle barreling. Additionally, because of the hardness, bullet dimensions can be made more precise than with traditional bullets. However, because of the hardness of the bullet as a whole, the bullet can create significant copper fouling in the barrel because of the reduced malleability or deformability of the solid copper bullet. Because of the increased hardness, the bullet isn't deformed as it engages the lans which cut into the bearing surface of the bullet. The displaced copper/gilding metal is then deposited within the barrel, resulting in loss of accuracy by disturbing the uniformity of the rifling and preventing the consistent travel of a projectile through the barrel.

To reduce the fouling discussed above, many bullet manufacturers have cut grooves into the bearing surface of the bullet. The grooves are cut in a plane perpendicular to the axis and direction of flight of the bullet. These grooves not only assist in reducing fouling by providing a space for the metal displaced by the lands to go, but also reduce pressure by reducing total bearing surface in frictional contact with the barrel rifling. Once the bullet exits the muzzle, the grooves, which are optimally cut in the bearing surface perpendicular to the direction of travel, affect the ballistic coefficient (a measure of aerodynamic drag) of the bullets upon exit and during flight. They do so by creating abrupt changes to the surface contour of the bullet shank. As most bullets are traveling over the speed of sound, and some at hypersonic speeds (over Mach 3), the turbulence created by the transverse grooves in the bearing surface create additional shock waves, causing turbulence, substantially increasing drag, and reducing the range that the bullet velocity will remain supersonic. As the bullet reaches approaches subsonic velocity a velocity zone is reached, known as the transonic zone, wherein there bullet can become unstable because of boundary layer separation of the air passing over the rear of the bullet. This destabilization can cause the bullet to deviate from its supersonic trajectory, which in turn has a detrimental effect on accuracy. Our design incorporates streamlining of the grove edges so that supersonic air travel is less impeded by the grove's leading and trailing edges. Some bullet manufacturers have attempted to increase the ballistic coefficient of such projectiles (as well as cup and core) by using a polymer tip at the nose of the bullet to reduce drag at supersonic speeds. While these polymer tips work to some degree, they also have a tendency to impede expansion of the bullet upon impact, and in any event do nothing to reduce the drag created by the transverse grooves.

Terminal performance of gilding metal bullets has also been an area of improvement over the years. While all bullets designed for the harvest of game animals or for self-defense are designed to expand to some degree on impact, the expansion has been has consistently been a trade-off between accuracy and effectiveness. For example, most bullets reliably expand optimally with a hollow-point design, which allows the fluid and tissue of the target to assist in bullet expansion. However, the hollow-point design creates additional unwanted nose drag during flight. To counter this issue, gilding metal bullets have posited that the polymer tips can aid expansion when, upon impact, the tip is forced back into the hollow cavity. However, the degree of expansion attributable to the plastic tip design is negligible. In fact, expansion is more reliable with a hollow point projectile. It is therefore desirable to have a tipped hollow point projectile whereby the tip is ejected upon impact, resulting in a hollow point for expansion purposes once the bullet impacts the target. The resultant hydraulic pressure is more effective in expanding the bullet along pre-scored lines within the hollow point. The resulting expansion into sharp petals, rapidly increases the frontal surface of the bullet and aids in transfer of the kinetic energy of the bullet to the target and creates a large wound cavity and cavitation effect within the target.

SUMMARY OF THE INVENTION

Based on the foregoing, an improved bullet design is needed. Projectiles in accordance with this invention includes a base, tail portion, bearing surface, and nose. The projectile is machined from a copper or other suitable gilding metal alloy, and includes one or more grooves disposed in area of the bearing surface of the projectile. An ejectable tip is disposed at the distal (from the base) end of the nose portion. The nose of the bullet has an ogive shape. Additionally, each of the grooves in the bearing surface between the bearing surface and the depth of the groove is shaped with at least a portion of an ogive, or parabola.

DETAILED DESCRIPTION OF THE INVENTION

In accordance with embodiments of the invention, a machined stock of copper, copper alloy, or other suitable materials for use as rifle projectiles, are manufactured to reduce drag and increase the ballistic coefficient of the projectile. Additionally, the projectiles are designed to achieve greater muzzle velocity through reduced bearing surface and reduce fouling in a steel or chrome-lined barrel.

Figure 1:
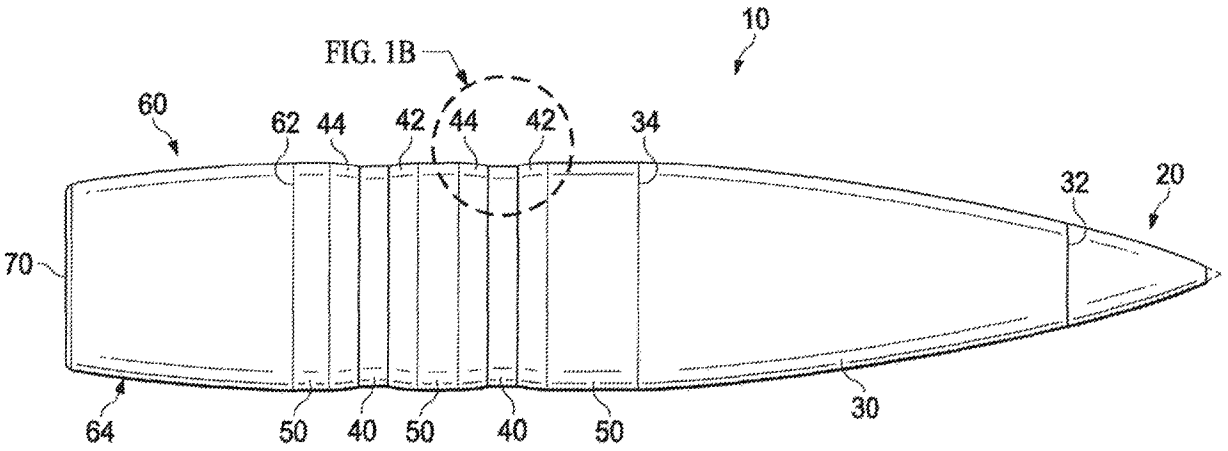
FIG. 1 is a representation of a completed projectile in accordance with an embodiment of the invention.
Figure 1B:
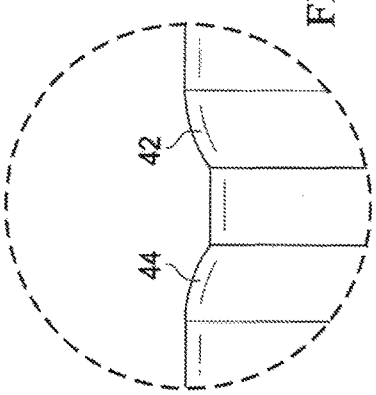
FIG. 1B is an expanded view of the transitions between the bearing surface and the grooves in accordance with an embodiment of the invention.
Figure 1A:
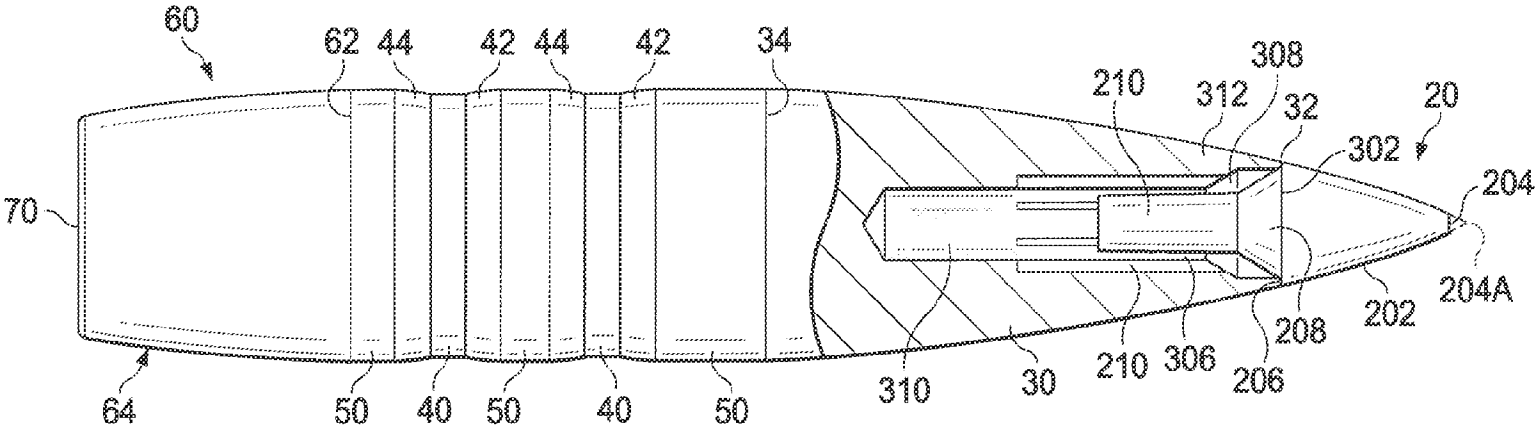
FIG. 1A is a cutaway view of the projectile shown in FIG. 1.

FIGS. 1 & 1A show an embodiment of the present invention. Projectile 10 shows a tip 20, a nose 30, grooves 40, bearing surfaces 50, tail portion 60, and base 70. Although not necessary, in a preferred embodiment, the projectile is machined of a uniform material, such as copper or copper alloy. The nose portion 30 includes a meplat 32 and a nose transition 34 where the nose meets the bearing surface. The shape of nose 30 is typically an ogive, which reduces the coefficient of drag of the projectile 10 and increases the ballistic coefficient. Because of the supersonic, and sometimes hypersonic, velocities of projectiles made in accordance with the present invention, the ogive is manufactured with a shape determined by applying the Von Karman equation. Typically, the bearing surface 50 is sized for the caliber of rifle designed for the projectile. For example, a .30 caliber rifle would fire a projectile with a diameter at the bearing surface 50 of 0.308" or 7.62 mm. The tail portion 60 is typically a "boat tail" design, and in the preferred embodiment, tail portion 60 also has tail transition 62 where the rearward-most bearing surface 50 ends and the tail begins to taper at tail surface 64 the shape of an ogive, or portion thereof, to the base 70. In certain embodiments, tail portion 60 need not be "boat tail", parabolic, or ogive in shape, but reducing the diameter of the tail portion 60 from a tail transition 62 to base 70 has been shown to increase the ballistic coefficient of projectile 10. Base 70 may be flat, concave, or convex.

Figure 4:
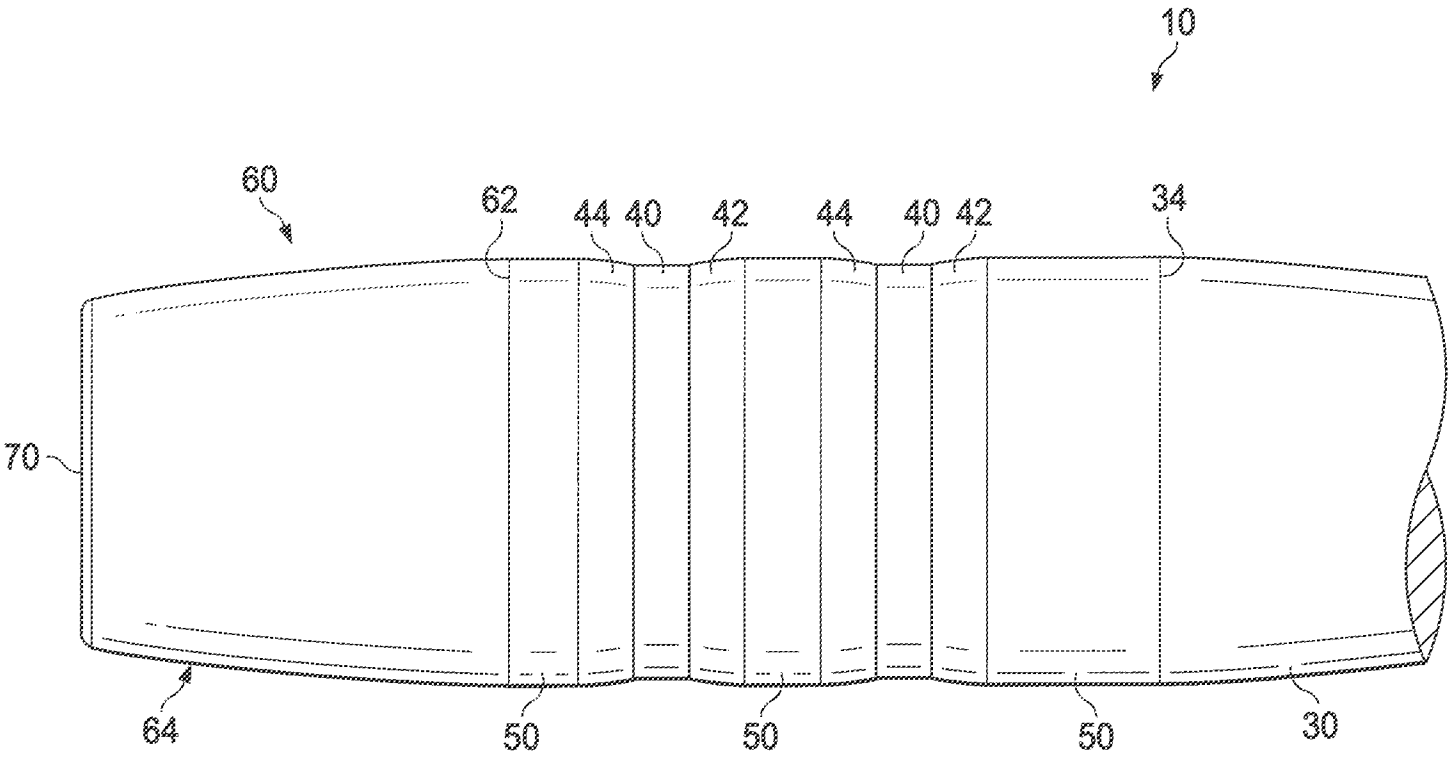
FIG. 4 is an enlarged view of the bearing surface, grooves, and transition portions of the projectile of FIGS. 1 & 1A.

As shown in FIGS. 1 and 1A, and in greater detail in FIG. 4, the bearing surface 50 has at least one groove 40 cut into it. Grooves 40 reduce the bearing surface in contact with the rifling of a barrel. Reducing the bearing surface has advantages. For example, in the case of a swaged lead jacketed bullet, the softer lead core allows the core to be deformed more easily under pressure from the lans of the rifle barrel, which reduces the amount of jacket material deposited in the interior of the barrel. However, with a projectile manufactured with a uniform material, such as copper, the projectile resists deformation, resulting in the lans cutting more copper when the projectile travels down the barrel. This additional projectile material increases barrel fouling, and can impede the projectile's travel through the barrel, potentially increasing pressure and friction and reducing muzzle velocity.

Grooves 40, however, both reduce the area of bearing surfaces 50, and provide a volume between the barrel and the projectile 10 that allows for the deposit of projectile material cut by the lans of the barrel as the projectile 10 travels down the barrel before exiting the muzzle.

In a preferred embodiment, the grooves 40 are cut into the bearing surface 50 such that the overall diameter at the groove is only slightly less than the bearing surface diameter. During testing, the inventors found that for a .308 caliber projectile, for example, the depth of grooves 40 is optimally 0.006 inches, such that the diameter of the projectile 10 at a groove 40 is 0.012" less than the 0.308" diameter of the bearing surface. As stated previously in the background of the invention, however, the grooves 40 have typically been cut into the bearing surface 50 at a right angle, or normal, to the bearing surface 50, resulting in a sharp edge between the bearing surface 50 and the base of groove 40. Lead transition 42 and trail transition 44 are present between the bearing surface 50 closes to the nose 30 and tail portion 60, respectively. In order to reduce the amount of turbulence created at the transitions 42 and 44, each transition 42 and 44 has a parabolic shape. Testing to date has shown that a parabolic profile of transitions 42 and 44 in accordance with the Von Karman ogive (LD-Haack) has the greatest reduction of turbulence, and thus the greatest increase in the ballistic coefficient of a projectile 10. The parabolic or ogive shape of the transitions 42 and 44 allow the projectile 10 to pass through air with a much-reduced drag coefficient. Additionally, as many cartridges are "crimped," by depressing the case mouth into a groove or cannelure of the projectile, the tapered nature of the transition 44 allows for a tighter crimp to secure the projectile 10 within a cartridge casing (not shown). The length of the transition 42 and 44 may be increased and/or decreased based on a given overall length of a projectile 10, the caliber of a projectile 10, or the number of grooves 40 desired or necessary for optimum aerodynamics. During testing, it has been shown that a 1:1:1 ratio of transition width:groove width:transition width is effective. For example, for a .308 caliber projectile 10 with two grooves 40, a groove width of 0.040", and the width of transitions 42 and 44 of 0.040" performs well, reducing the overall bearing surface to approximately 0.3" from over 0.5". This reduction of bearing surface allows for reduced friction within the barrel while still providing adequate bearing surface to maintain sufficient pressure and stabilization. For larger calibers with greater overall length, such as .338 caliber, widths of grooves 40 and transitions 42 and 44 may be used. Likewise smaller widths may be used for smaller caliber projectiles.

Figure 2:
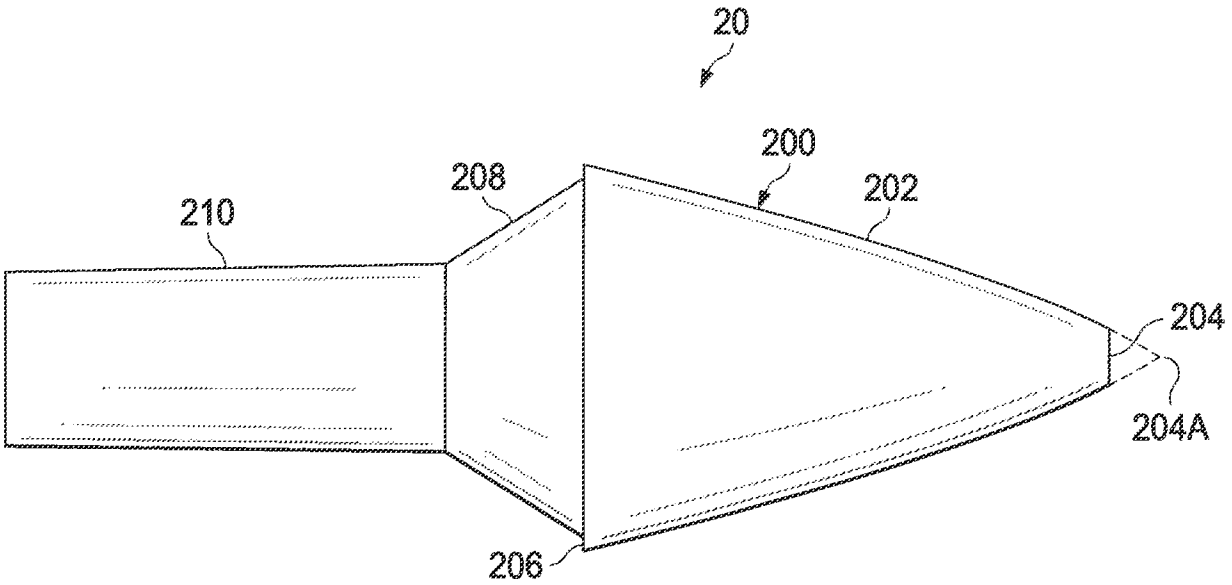
FIG. 2 is a representation of the tip portion of the projectile shown in FIGS. 1 & 2.
Figure 3:
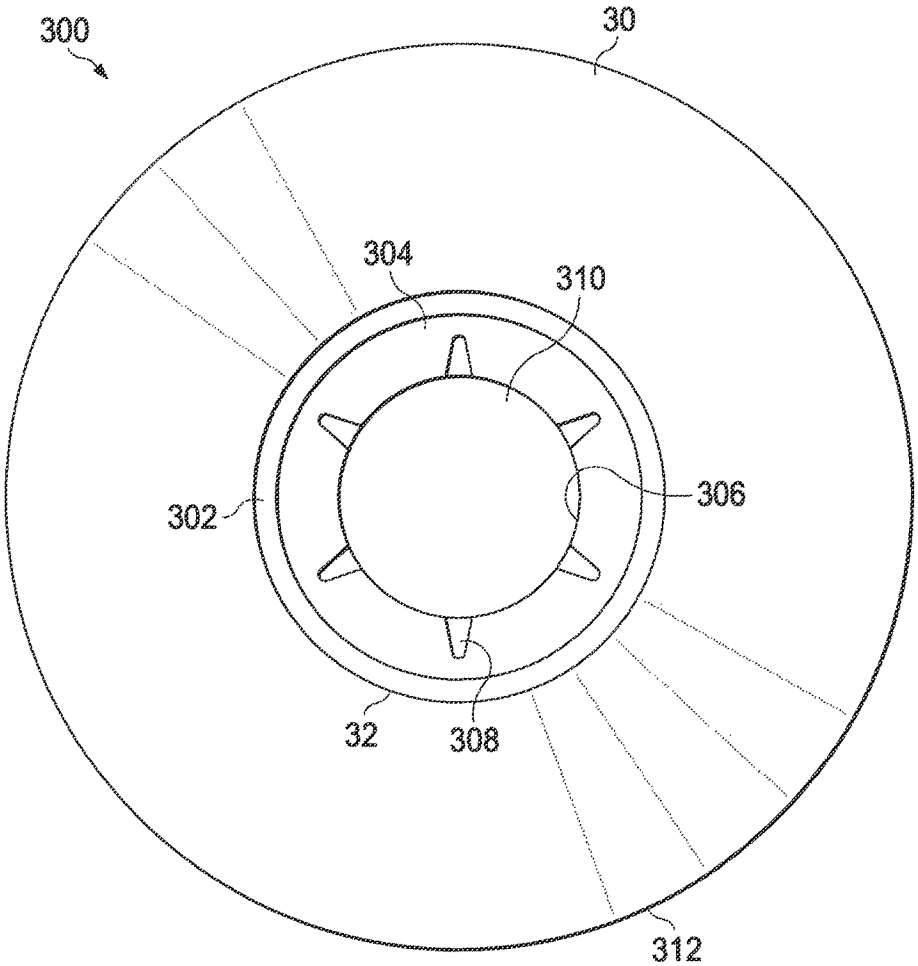
FIG. 3 is a perspective view of the projectile shown in FIGS. 1 & 2 without the tip portion.

As shown in FIGS. 1, 1A, and 2, projectile 10 also includes tip 20. Tip 20 may be of any suitable metal or polymer, but in the preferred embodiment, is it machined from aluminum. As shown in FIGS. 2 and 3, tip 20 includes a tip nose 202, a tip point 204 or 204A, seating surface 206, bevel 208, and shank 210.

As shown in FIG. 3, projectile 10 has a hollow meplat at 32. At meplat 32, the projectile 10 includes a nose rim 302, and a seating cavity 304, a seating channel 306, fracture grooves 308, and an expansion channel 310 disposed therein. The configuration of the cavity disposed within hollow meplat 32 works in concert with tip 20 as shown in the cutaway depiction of FIG. 1A. Tip 20 may have a flat meplat at tip point 204, or may have a pointed tip point 204A. Shank 210 is configured to be inserted and secured in seating channel 306. Bevel 208 is designed to be inserted within seating cavity 304, and has a diameter less than the diameter of the seating face 206 at bevel 208's widest point. Seating face 206 is configured to rest against nose rim 302 when the tip shank 210 is inserted into the seating channel 306. In one embodiment, tip shank 210 and seating channel 306 are configured such that tip shank 210 is held in seating channel 306 by friction, though a suitable adhesive may be applied to prevent tip 20 from being prematurely ejected from hollow meplat 32.

Tip 20 provides additional ballistic performance to projectile 10 by increasing the ballistic coefficient and decreasing drag during flight. Upon impact of the tip 20 with a relatively soft or fluid target, like a game animal, the impact drives tip 20 into the nose rim 32. Nose wall 312 in the vicinity of nose rim 302 is of sufficient thinness that the force of the seating face 206 of tip 20 being driven backward causes the nose wall 312 to deform. This deformation allows fluid into the hollow meplat 32 which disrupts the frictional seat of tip shank 210 in seating channel 306. Because tip 20 is preferable manufactured from a material harder than the copper or copper alloy of the rest of projectile 10, the tip 20 is ejected from the projectile 10 as it travels through a fluid target. The ejection of tip 20 may create a secondary wound channel in an animal further increasing the lethality and humaneness of a game harvest. The primary benefit, however, is that once the tip 20 is ejected from hollow meplat 32, it allows fluid to enter the seating channel and expansion channel of projectile 10. While some prior art references claim that ballistic tips such as tip 20 may aid in expansion by driving back into the projectile, the inventors' testing has shown that projectiles manufactured in accordance with the present invention provide more reliable expansion at lower velocities when tip 20 is ejected from hollow meplat 32, allowing fluid to drive expansion. Fracture grooves 308 create shear points in the hollow meplat 32, such that when fluid enters the hollow meplat, the nose wall 312 fractures at the nose groove 308. After fracture, the projectile 10 peels back to create a larger frontal surface area and thus, a greater diameter wound channel. In one embodiment, six fracture grooves 308 are formed in the interior of hollow meplat 308, though one of ordinary skill in the art will recognize that any number of grooves may be used. Additionally, expansion channel 310 is deeper than seating channel 306. During expansion, the "petals" created by the expansion of projectile 10 are configured peel back to the end of expansion channel 310. At lower impact velocities, expansion may not proceed all the way to the base of expansion channel 310, while at higher velocities, expansion may proceed beyond the end of expansion channel 310, as should be apparent to one of ordinary skill in the art.

In practice, projectile 10 may be made from solid bar stock copper or copper alloy. The nose 30, bearing surface 50, and tail portion are typically machined by a lathe, waterjet, or CNC machine, but may also be machined using hand tools. In addition to copper, any suitable alloy may be used, such as tin, gilding metal, brass, and even mild steel, subject to law and the rules covering projectiles. In practice, the range of suitable alloys is limited only by the hardness of the barrel of the rifle used to fire the projectile, and the need for the projectile 10 to be fired reliably 26 in a firearm. Tip 20 may be machined from any suitable material, and is limited only in that tip 20 is preferably made of a harder material than the body of projectile 10 so that upon impact, it is capable of deforming the hollow meplat 32 sufficiently to create instability to eject the tip 20 upon impact, or shortly thereafter. Materials such as titanium, tungsten, steel, iron, Kevlar, and nylon may be used, subject to the limitations described herein. Additional changes and or modifications of materials, dimensions, and methods may be used in accordance with the present invention, and within the skill of one of ordinary skill in the art.

What is claimed is:

1. A projectile comprising:

a projectile body comprising a nose portion, a tail portion, a base, a bearing surface, and a groove cut into the bearing surface, wherein the portion of the projectile between the bearing surface and the groove comprises a curved first transition portion, wherein the curved first transition portion is convex from the bearing surface to the groove relative to a longitudinal axis defined by the center of the nose portion and the center of the base, wherein the curved first transition portion is tangential to the bearing surface, and wherein the curved first transition portion is defined by the von Karman equation.

2. The projectile of claim 1, wherein the projectile body is manufactured from a material containing at least one of copper, tin, tungsten, aluminum, iron, or gilding metal.

3. The projectile of claim 1, further comprising:

a hollow meplat having a nose rim surrounding an opening;

a nose wall extending from the nose rim toward the base of the projectile;

a seating channel; and a tip operable to be seated in the seating channel, the tip comprising a shank, a seating face, a tip nose, and a tip meplat, wherein the tip shank is configured to fit inside the seating channel, and wherein the tip is configured to eject from the hollow meplat after impact with a soft target.

4. The projectile of claim 3, wherein after impact, the seating face of the tip is configured to transfer force from the impact to the nose rim, and wherein the nose wall is configured to deform sufficiently under the transferred force to disrupt the seating of the tip shank in the seating channel.

5. The projectile of claim 4, further comprising a fracture groove in the interior of the hollow meplat, wherein the fracture groove is configured to assist fracturing of the nose wall to facilitate expansion of the projectile.

6. The projectile of claim 4, wherein the tip is aluminum and the projectile body is one of copper or a copper alloy.

7. The projectile of claim 3, the tip further comprising a beveled transition having a maximum diameter less than the seating surface, wherein the beveled portion reduces from the seating face to the shank, and where in the shank is operable to be seated in the seating channel, and the seating face is operable to be disposed against the nose rim when the shank is seated in the seating channel.

8. The projectile of claim 3, wherein the tip is manufactured from a material with greater hardness than the material of the projectile body.

9. The projectile of claim 3, wherein the tip is comprised of a metal having a greater hardness than the material of the projectile body.

10. The projectile of claim 1, further comprising a curved second transition portion between the bearing surface and the groove.

11. The projectile of claim 10, wherein the curved second transition portion is defined by the von Karman equation.

12. The projectile of claim 1, wherein the nose portion has an ogive shape.

13. The projectile of claim 12, wherein the tail portion has a parabolic cross-section from the bearing surface to the base.

14. The projectile of claim 1, wherein the nose portion, tip, and base are manufactured with at least a portion of an ogive shape.

15. The projectile of claim 14, wherein the at least a portion of an ogive shape is defined by the von Karman equation.

16. The projectile of claim 1, wherein the projectile comprises at least one additional groove cut into the bearing surface, wherein each additional groove has a curved first transition portion and a curved second transition portion.

* * * * *